US011156407B2

(12) United States Patent
McCants et al.

(10) Patent No.: US 11,156,407 B2
(45) Date of Patent: Oct. 26, 2021

(54) PULSE PUMP FOR THE ENHANCEMENT OF THERMAL TRANSPORT IN HYDRONIC SMALL-SCALE HEAT TRANSFER SYSTEMS

(71) Applicant: Ice Dragon Cooling, LLC, Columbia, SC (US)

(72) Inventors: Dale McCants, Ravenel, SC (US); Andrew Hayes, Littleton, CO (US)

(73) Assignee: ICE DRAGON COOLING, LLC, Columbia, SC (US)

( * ) Notice: Subject to any disclaimer, the term of this patent is extended or adjusted under 35 U.S.C. 154(b) by 0 days.

(21) Appl. No.: 16/872,160

(22) Filed: May 11, 2020

(65) Prior Publication Data

US 2020/0355440 A1 Nov. 12, 2020

Related U.S. Application Data

(60) Provisional application No. 62/846,001, filed on May 10, 2019.

(51) Int. Cl.
*F28D 15/00* (2006.01)
*F04B 43/02* (2006.01)

(52) U.S. Cl.
CPC ..... *F28D 15/00* (2013.01); *F04B 43/02* (2013.01)

(58) Field of Classification Search
CPC ..... F28D 15/00; F04B 43/02
USPC ..... 165/104.31
See application file for complete search history.

(56) References Cited

U.S. PATENT DOCUMENTS

| | | | | |
|---|---|---|---|---|
| 2,086,442 | A * | 7/1937 | Rushmore | F01P 3/22 237/12.3 R |
| 3,683,944 | A * | 8/1972 | Anderson | A47L 15/0002 134/57 R |
| 5,968,464 | A * | 10/1999 | Peter-Hoblyn | F01N 3/2066 423/235 |
| 8,222,190 | B2 | 7/2012 | Zhamu et al. | |
| 9,315,388 | B2 | 4/2016 | Burton et al. | |
| 9,738,528 | B2 | 8/2017 | Lee et al. | |
| 9,803,124 | B2 | 10/2017 | Zhamu et al. | |
| 2008/0200343 | A1* | 8/2008 | Clemens | G01N 27/27 506/9 |
| 2012/0245058 | A1 | 9/2012 | Monteiro et al. | |
| 2013/0341028 | A1 | 12/2013 | Christian et al. | |
| 2014/0097380 | A1 | 4/2014 | Wu et al. | |
| 2014/0312263 | A1 | 10/2014 | Timofeeva et al. | |
| 2015/0307763 | A1 | 10/2015 | Singh et al. | |

(Continued)

*Primary Examiner* — Davis D Hwu
(74) *Attorney, Agent, or Firm* — Jeffrey C. Watson; Mathew L. Grell; Grell & Watson Patent Attorneys LLC

(57) ABSTRACT

A pulse pump for the enhancement of thermal transport in a hydronic small-scale heat transfer system includes an inlet, a pulsing chamber, a plurality of apertures, a flow channel, an outlet and a pulsing pump. The pulsing chamber is in fluid communication with the inlet. The plurality of apertures is at a bottom of the pulsing chamber. The flow channel is sealed to the bottom of the pulsing chamber below the plurality of apertures. The flow channel is configured to house the hydronic small-scale heat transfer system. The outlet is in fluid communication with the flow channel. The pulsing pump is in communication with the pulsing chamber and is configured for intermittently forcing fluid in the pulsing chamber through the apertures at the bottom of the pulsing chamber thereby creating turbulence in the flow channel.

20 Claims, 8 Drawing Sheets

(56) References Cited

U.S. PATENT DOCUMENTS

| | | | |
|---|---|---|---|
| 2016/0024374 | A1 | 1/2016 | Sadana et al. |
| 2016/0194575 | A1 | 7/2016 | Ramon Raygoza et al. |
| 2016/0272583 | A1 | 9/2016 | Lee et al. |

* cited by examiner

PULSE PUMP FOR THE ENHANCEMENT OF THERMAL TRANSPORT IN HYDRONIC SMALL-SCALE HEAT TRANSFER SYSTEMS

CROSS-REFERENCE TO RELATED APPLICATIONS

This application claims the priority benefit of U.S. Provisional Application No. 62/846,001, filed on May 10, 2019, entitled "Net Zero Pulse Pump for the Enhancement of Thermal Transport in Hydronic Small-Scale Heat Transfer Systems", which is incorporated by reference herein in its entirety.

FIELD OF THE DISCLOSURE

The present disclosure relates to thermal transport enhancement of hydronic (liquid cooled or heated) systems that use forced convection to transfer heat. More particularly, the present disclosure relates to systems that use a fluid to remove heat or add heat to or from a source. Namely, the present disclosure relates to a pulse pump for the enhancement of thermal transport in hydronic small-scale heat transfer systems.

BACKGROUND

In general, hydronics is the use of a liquid heat-transfer medium in heating and cooling systems. The working fluid is typically water, glycol, or mineral oil. Some of the oldest and most common examples are steam and hot-water radiators. Fluid systems have been used to remove heat from sources for many years. Internal combustion engines, HVAC systems, and the electronic industry are but a few examples of heat transfer by means of fluid systems. Although not limited thereto, the instant disclosure may be directed to small scale heat transfer systems. Small scale heat transfer systems are comprised of a closed loop with a small heat exchanger for which the working fluid absorbs or rejects heat from a body and a larger heat exchanger for which the working fluid can absorb or reject heat to or from the environment. These small scale systems are compact and commonly contain high surface areas for their respective size. Because of the compact size, micro-channels are common in the small heat exchanger.

Many advances in heat transfer engineering have advanced the science and efficiency of hydronic systems. In the world of fluid dynamics and heat transfer primary technologies have developed over the years allowing advancements to increased thermal transport. One of the oldest and more challenging to mathematically model is turbulence in the flow. For many decades continued scientific work has helped improve understanding and modeling capabilities related to turbulent flow. It is known that turbulent flow as opposed to laminar flow is, in most cases, more advantageous with regards to heat transfer. How turbulent flow effects or enhances heat transfer is also understood. The formation and existence of turbulent eddies in the flow is known to assist thermal transport. The presence of the turbulent eddies enhance the convective heat transfer of fluid through disturbance in the boundary layer near the flow boundary. The size of the turbulent eddies and their frequency (referred to as turbulent intensity) is an important aspect of thermal management in systems. From heat transfer theory it can be deduced that increased turbulent intensity creates a condition for increased convective heat transfer.

However, typically to reach a higher turbulent flow regime, increased flow is required. Therefore, the increase in turbulent intensity is at the expense of increased pump work. Changing the geometry of the inside of the flow channel can increase turbulence but the increase in cost to manufacture and increase in pump work related to pumping through such pipes has been shown not to be worth doing and is not commonly used in commercial or industrial applications. Furthermore, in compact heat exchangers, which use micro-channels, it is impractical to create geometries which would achieve turbulent flow, because of the complexity of manufacturing. Also, in straight micro-channels, which are the most commonly used, the velocity of fluid required to achieve turbulent flow is practically impossible to achieve and certainly not practical for those types of smaller systems.

Therefore the instant disclosure embraces the need and/or desire for a means and/or method to increase the turbulence in the flow of hydronic small-scale heat transfer systems with low manufacturing cost and an overall system efficiency increase.

The instant disclosure may be designed to address at least certain aspects of the problems or needs discussed above by providing a pulse pump for the enhancement of thermal transport in hydronic small-scale heat transfer systems.

SUMMARY

The present disclosure may solve the aforementioned limitations of the currently available hydronic small-scale heat transfer systems by providing a pulse pump for the enhancement of thermal transport in a hydronic small-scale heat transfer system. The pulse pump for the enhancement of thermal transport in a hydronic small-scale heat transfer system may include an inlet, a pulsing chamber, a plurality of apertures, a flow channel, an outlet and a pulsing pump. The pulsing chamber may be in fluid communication with the inlet. The plurality of apertures may be at a bottom of the pulsing chamber. The flow channel may be sealed to the bottom of the pulsing chamber below the plurality of apertures. The flow channel may be configured to house the hydronic small-scale heat transfer system. The outlet may be in fluid communication with the flow channel. The pulsing pump may be in communication with the pulsing chamber and may be configured for intermittently forcing fluid in the pulsing chamber through the apertures at the bottom of the pulsing chamber thereby creating turbulence in the flow channel.

One feature of the disclosed pulse pump for the enhancement of thermal transport in a hydronic small-scale heat transfer system may be that the turbulence created in the flow channel may enhance thermal transport in the hydronic small-scale heat transfer system.

In select embodiments, the disclosed pulse pump for the enhancement of thermal transport in a hydronic small-scale heat transfer system may be a net zero pulse pump. The net zero pulse pump may be configured wherein flow between the inlet and the outlet is in a closed loop of the hydronic small-scale heat transfer system, where no fluid is added or taken out of the closed loop of the hydronic small-scale heat transfer system.

In select embodiments of the disclosed pulse pump for the enhancement of thermal transport in a hydronic small-scale heat transfer system, the plurality of apertures may include a plurality of rows of the apertures. Each of the plurality of apertures may have a shape. The shape may be, but is not limited to, a circular hole shape, a star shape, a plus sign shape, a slit shape, a slot shape, a spread nozzle with a specific angle, the like, or combinations thereof. In select possibly preferred embodiments, the shape of each of the plurality of apertures may be slot shaped apertures. The slot shaped apertures of each of the plurality of apertures may be angled slots. The angled slots may be angled from the inlet side of the pulsing chamber down to the flow channel towards the outlet in the flow channel. The plurality of angled slot shaped apertures may include a plurality of rows of the angled slot shaped apertures.

In select embodiments of the disclosed pulse pump for the enhancement of thermal transport in a hydronic small-scale heat transfer system, the hydronic small-scale heat transfer system may include micro-channels positioned in the flow channel. Wherein, the pulsing pump may be configured to force fluid from the apertures to be injected into the micro-channels with turbulent vortexes for the enhancement of thermal transport into the micro-channels. In select embodiments, the micro-channels may be positioned on a copper block sealed to the bottom of the pulsing chamber. The copper block may include an inlet chamber on one side of the micro-channels and an outlet chamber on another side of the micro-channels.

In select embodiments of the disclosed pulse pump for the enhancement of thermal transport in a hydronic small-scale heat transfer system, a first one-way valve may be included. The first one-way valve may be positioned in the inlet. Where, the first one-way valve may be configured for only allowing flow from the inlet to the pulsing chamber.

In select embodiments of the disclosed pulse pump for the enhancement of thermal transport in a hydronic small-scale heat transfer system, a second one-way valve may be included. The second one-way valve may be positioned in the outlet. Where, the second one-way valve may be configured for only allowing flow from the flow channel out of the outlet.

In other select embodiments of the disclosed pulse pump for the enhancement of thermal transport in a hydronic small-scale heat transfer system, a first one-way valve may be included and a second one-way valve may be included. The first one-way valve may be positioned in the inlet, where the first one-way valve may be configured for only allowing flow from the inlet to the pulsing chamber. The second one-way valve may be positioned in the outlet, where the second one-way valve may be configured for only allowing flow from the flow channel out of the outlet.

In other select embodiments of the disclosed pulse pump for the enhancement of thermal transport in a hydronic small-scale heat transfer system, the pulsing pump may include a flexible diaphragm. The flexible diaphragm may be positioned at a top of the pulsing chamber. The flexible diaphragm may be configured for flexing downward for forcing fluid in the pulsing chamber through the plurality of apertures at the bottom of the pulsing chamber. In select embodiments, the flexible diaphragm may be biased upwards for moving the flexible diaphragm upward after it has been flexed downwards by the pulsing pump. Wherein, when the flexible diaphragm is biased upward fluid is pulled into the pulsing chamber from the inlet. In select embodiments, a spring may be positioned inside of the pulsing chamber. The spring may be positioned inside of the pulsing chamber may be configured for biasing the flexible diaphragm upward from the pulsing chamber. A spacer may also be included on top of the flexible diaphragm. The spacer may include an insert configured for being forced down onto the flexible diaphragm for compressing the flexible diaphragm downwards into the pulsing chamber.

In other select embodiments of the disclosed pulse pump for the enhancement of thermal transport in a hydronic small-scale heat transfer system, the pulsing pump may include a driving mechanism. The driving mechanism may be configured for compressing the flexible diaphragm downwards at a set interval.

In select embodiments, the driving mechanism may include a horizontal motor with a horizontal drive shaft including an offset cam attached to the horizontal drive shaft. The offset cam may be positioned on top of the flexible diaphragm. Wherein, when the horizontal drive shaft is rotated by the horizontal motor, the offset cam is configured to compress the diaphragm downwards at the set interval.

In other select embodiments, the driving mechanism may include a vertical motor with a vertical drive shaft including a wavy disc attached to the vertical drive shaft. The wavy disc may be positioned on top of the flexible diaphragm. Wherein, when the vertical drive shaft is rotated by the vertical motor, the wavy disc may be configured to compress the diaphragm downwards at the set interval.

In other select embodiments, the driving mechanism may include a single motor two pump configuration The single motor two pump configuration may be configured to operate two of the pulse pumps via a single motor. In select embodiments of the single motor two pump configuration, the single motor may include a single horizontal drive shaft linked to two cranks via connecting rods. In other select embodiments of the single motor two pump configuration, the single motor may be linked to two piston cylinders.

In other select embodiments, the driving mechanism may include a two motor two pump configuration. The two motor two pump configuration may be configured to operate two of the pulse pumps via two motors. In select embodiments of the two motor two pump configuration, each of the two motors may include a horizontal drive shaft with an offset cam thereon. In other select embodiments of the two motor two pump configuration, each of the two motors may be a piezo electric disc configured to operate the flexible diaphragm of the pulse pump.

In select embodiments, each of the motors may be housed in a motor mount. The motor mount may be configured for positioning the motor in communication with the flexible diaphragm. In select embodiments, the motor mount may include a lubricating device configured for keeping the motor it houses lubricated.

In another aspect, the instant disclosure embraces the pulse pump for the enhancement of thermal transport in a hydronic small-scale heat transfer system in any of the various embodiments and/or combination of embodiments shown and/or described herein.

In another aspect, the instant disclosure embraces a method for the enhancement of thermal transport in a hydronic small-scale heat transfer system. The disclosed method for the enhancement of thermal transport in a hydronic small-scale heat transfer system generally includes providing and utilizing the disclosed pulse pump in any embodiment or combination of embodiments shown and or described herein. As such, the disclosed method for the enhancement of thermal transport in a hydronic small-scale heat transfer system may include the step of providing the disclosed pulse pump for the enhancement of thermal transport in a hydronic small-scale heat transfer system in any of the various embodiments and/or combination of embodiments shown and/or described herein. With the provided pulse pump, the method may also include the steps of: housing the hydronic small-scale heat transfer system in the flow channel, where the hydronic small-scale heat transfer system is sealed between the plurality of apertures at the bottom of the pulsing chamber and the outlet; and creating turbulence in the flow channel by intermittently forcing fluid in the pulsing chamber through the apertures at the bottom of the pulsing chamber.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
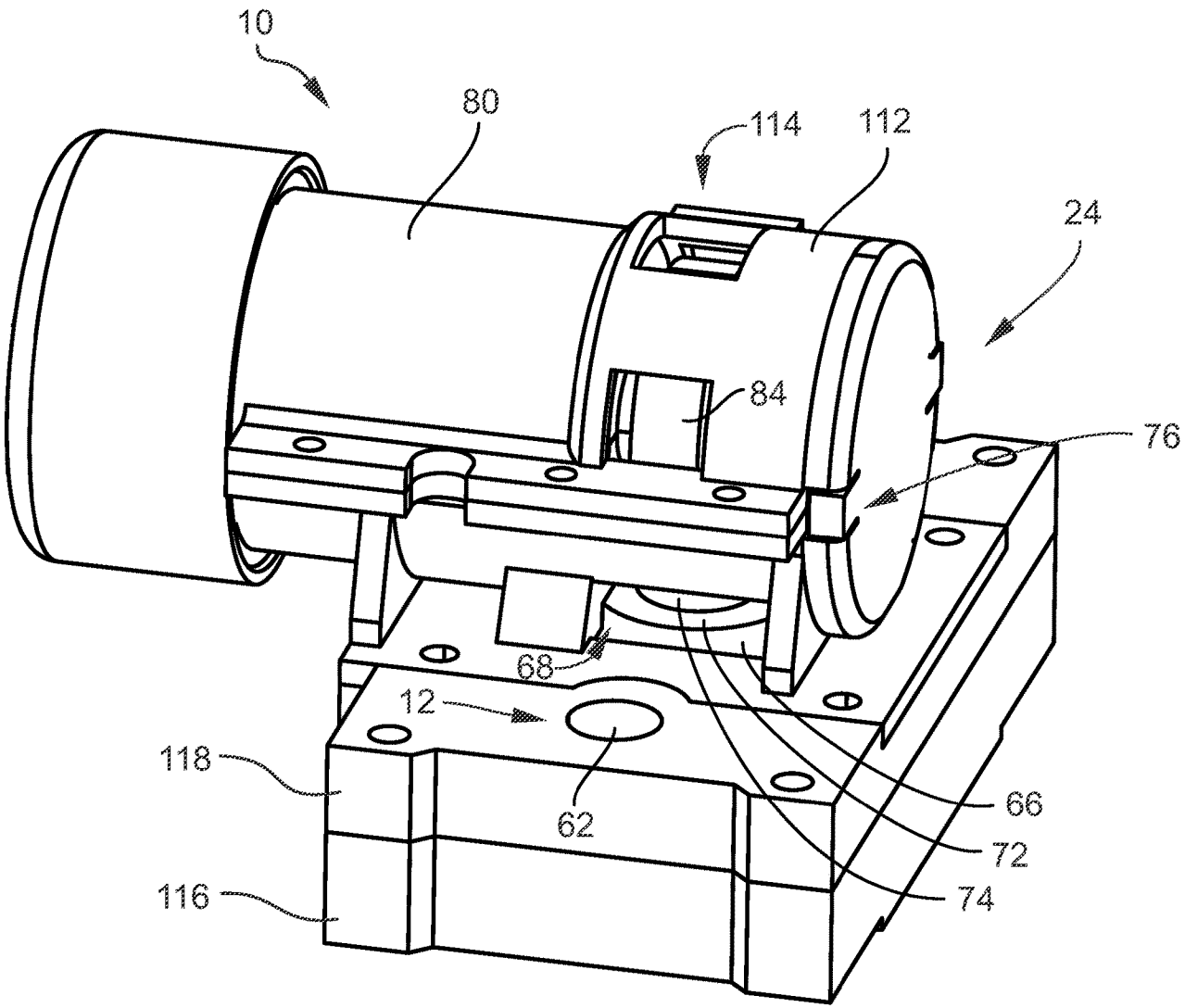
FIG. 1 shows a perspective view of a pulse pump for the enhancement of thermal transport in hydronic small-scale heat transfer systems according to select embodiments of the instant disclosure with a horizontal motor and offset cam configuration for operating the pulse pump.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-11, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring now to FIGS. 1-10, the present disclosure solves the aforementioned limitations of the currently available hydronic small-scale heat transfer systems by providing pulse pump 10. Pulse pump 10 may be designed and configured for the enhancement of thermal transport in a hydronic small-scale heat transfer system 11. Pulse pump 10 may be used on any various size, shape or configuration of hydronic small-scale heat transfer system 11. As an example, as shown best in FIG. 5, hydronic small-scale heat transfer system 11 may include micro-channels 48 configured for heat transfer on a small-scale. Pulse pump 10 for the enhancement of thermal transport in hydronic small-scale heat transfer system 11 may generally include inlet 12, pulsing chamber 14, plurality of apertures 16, flow channel 20, outlet 22 and pulsing pump 24. Pulsing chamber 14 may be in fluid communication with inlet 12. Plurality of apertures 16 may be at bottom 18 of pulsing chamber. Flow channel 20 may be sealed to bottom 18 of pulsing chamber 14 below plurality of apertures 16. Flow channel 20 may be configured to house hydronic small-scale heat transfer system 11. Outlet 22 may be in fluid communication with flow channel 20. Pulsing pump 24 may be in communication with pulsing chamber 14 and may be configured for intermittently forcing fluid in pulsing chamber 14 through the plurality of apertures 16 at bottom 18 of pulsing chamber 14 thereby creating turbulence in flow channel 20. This turbulence created in flow channel 20, like turbulent vortexes 50 may be in, on or around hydronic small-scale heat transfer system 11 for enhancing the thermal transport in hydronic small-scale heat transfer system 11, like in, on or around micro-channels 48 for enhancing the thermal transport of micro-channels 48. As such, one feature of the disclosed pulse pump 10 for the enhancement of thermal transport in hydronic small-scale heat transfer system 11 may be that the turbulence created in flow channel 20, like turbulent vortexes 50, may enhance thermal transport in the hydronic small-scale heat transfer system 11.

One feature of pulse pump 10 for the enhancement of thermal transport in hydronic small-scale heat transfer system 11 may be that it can be a net zero pulse pump. The net zero pulse pump may be configured wherein flow between inlet 12 and outlet 22 may be in a closed loop of the hydronic small-scale heat transfer system 11. As a result, by using the net zero pulse pump, no fluid is added or taken out of the closed loop of hydronic small-scale heat transfer system 11. By using a net zero pulse pump device for the purpose of creating turbulence in the fluid, a new method of increasing thermal transport has been created. This method uses pulse jets injected into the flow channel 20. This novel approach along with advanced understanding of fluid dynamics and heat transfer increases and improves thermal transport in hydronic (liquid cooled or heated) thermal management systems. By making pulse pump 10 a net zero pulse pump, the cost of operation and cost of manufacturing can be kept to a minimum. However, the disclosure is not so limited and pulse pump 10 may also add or remove hot/cold fluid to the loop of hydronic small-scale heat transfer system 11, as desired.

Figure 2:
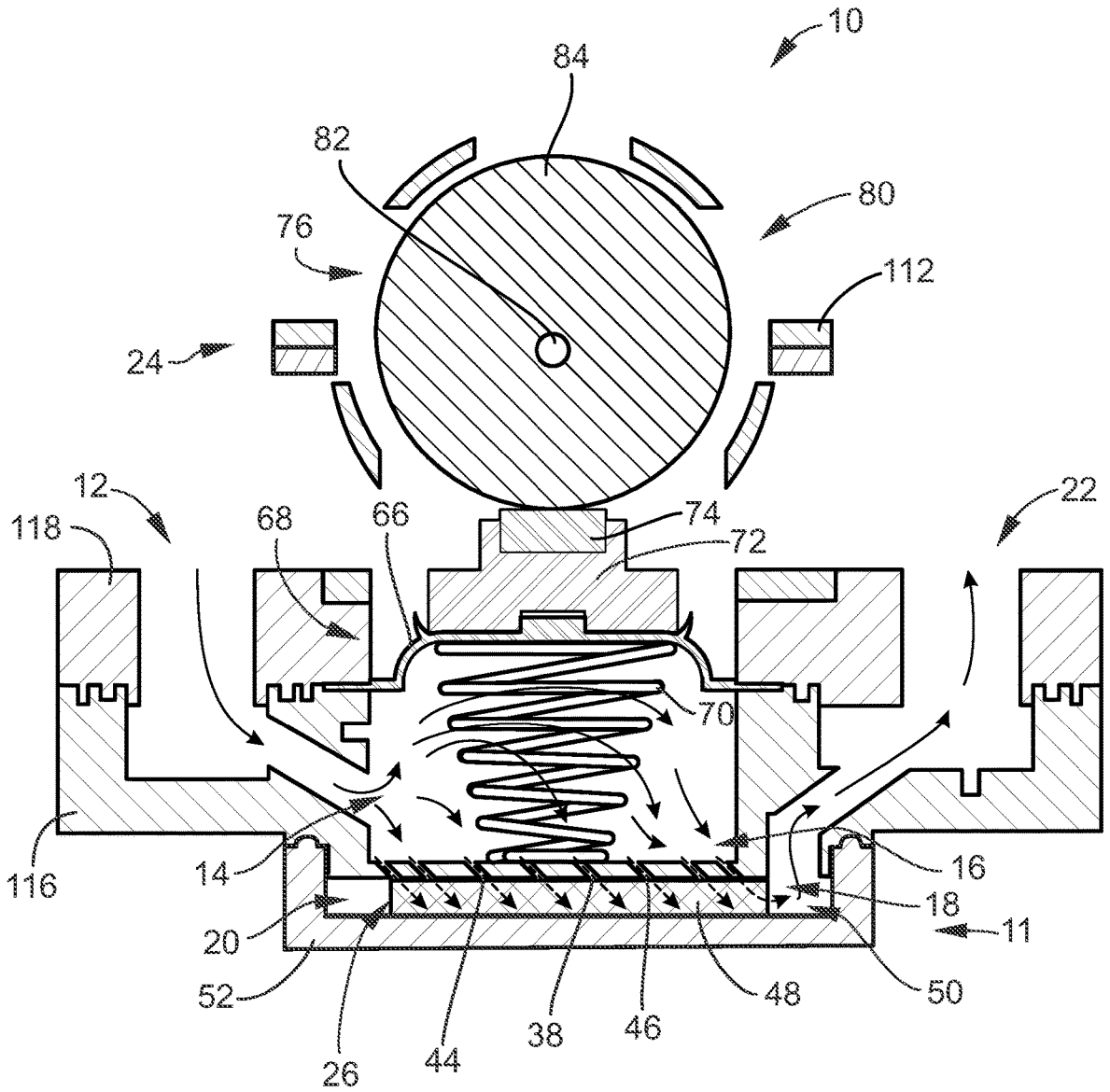
FIG. 2 shows a cross-sectional view of the pulse pump for the enhancement of thermal transport in hydronic small-scale heat transfer systems from FIG. 1 showing the horizontal motor and offset cam configuration for operating the pulse pump.
Figure 5:
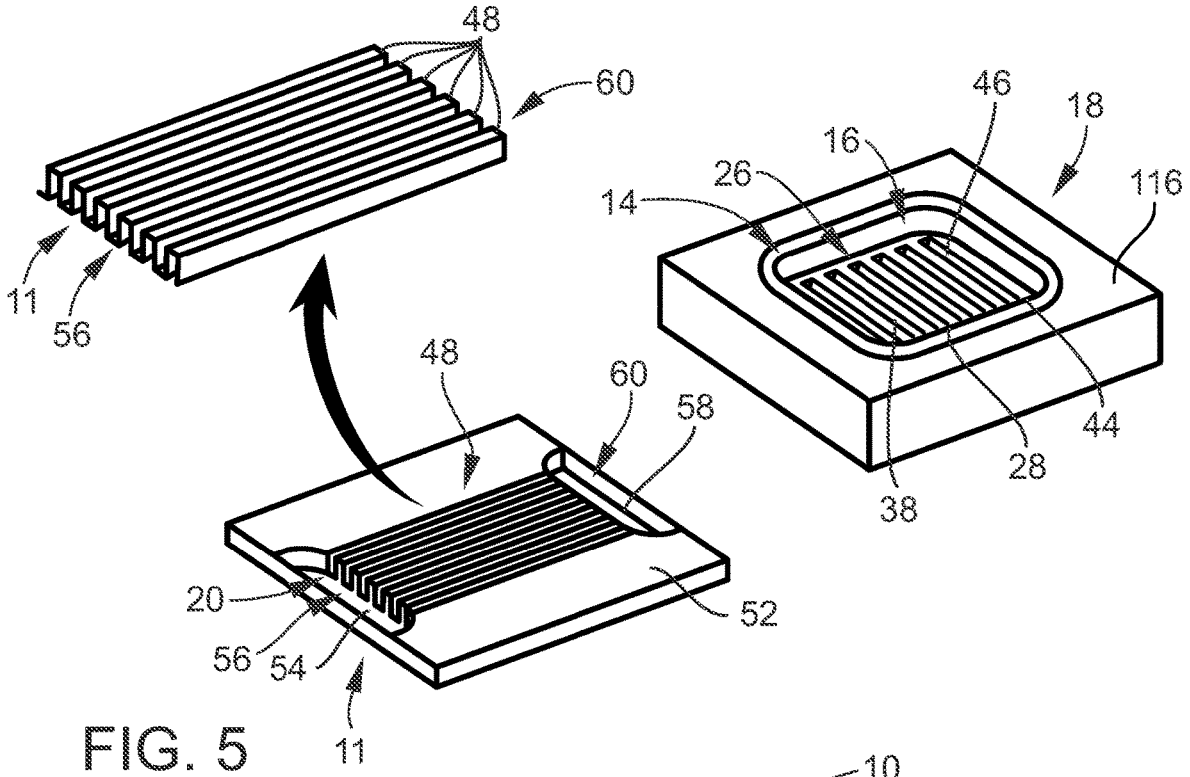
FIG. 5 shows a perspective view of a disassembled portion of the micro channels from the micro channels holder and the bottom housing with slots configured for creating turbulence into the micro channels according to select embodiments of the instant disclosure.
Figure 6:
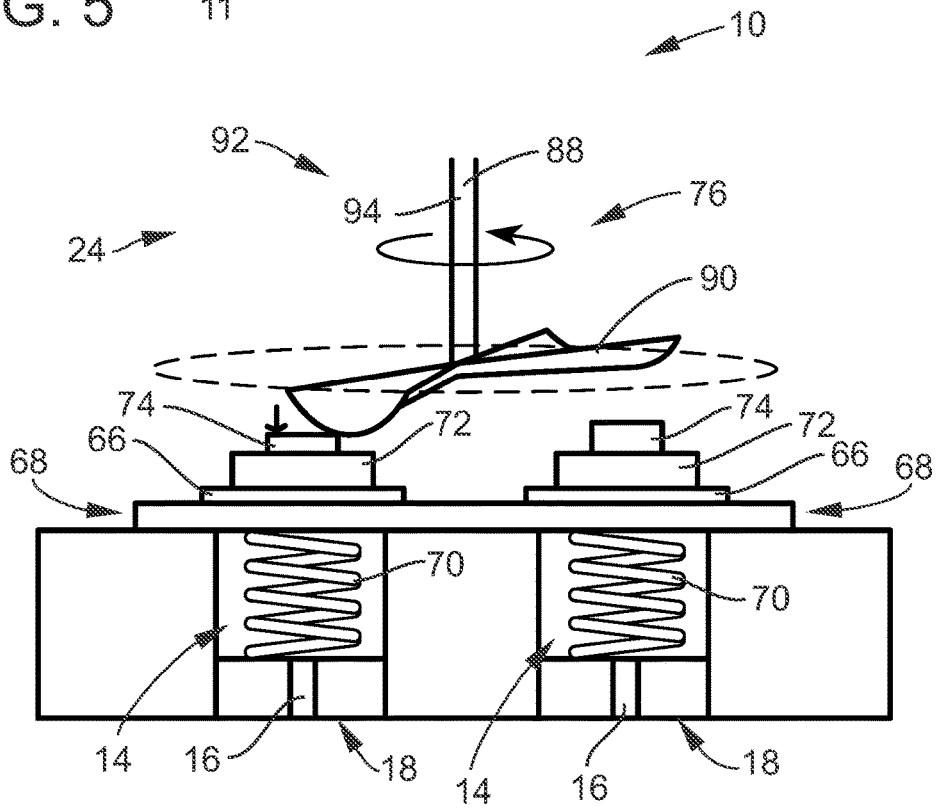
FIG. 6 shows a schematic side view of a pulse pump for the enhancement of thermal transport in hydronic small-scale heat transfer systems according to select embodiments of the instant disclosure with a vertical motor and wavy disc configuration for operating 2 pulse pumps.
Figure 9:
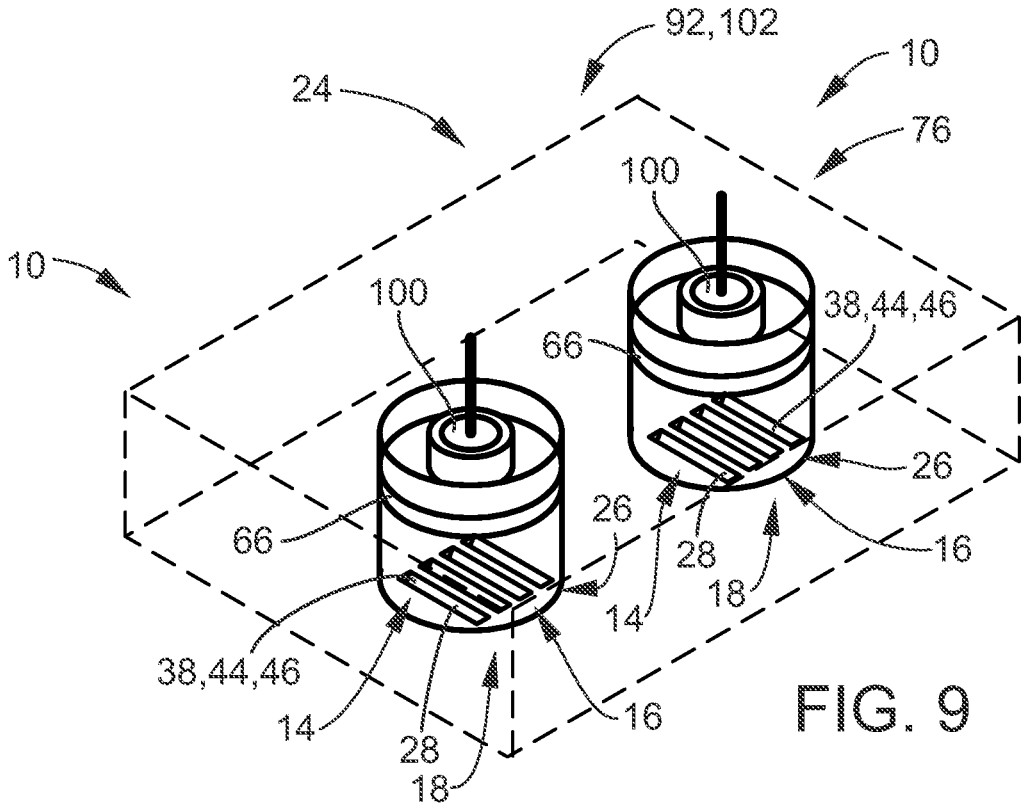
FIG. 9 shows a schematic perspective view of a pulse pump for the enhancement of thermal transport in hydronic small-scale heat transfer systems according to select embodiments of the instant disclosure with 2 piston and cylinder configurations for operating 2 pulse pumps.

Plurality of apertures 16 may be included in pulse pump 10. Apertures 16 may be for creating turbulence like turbulent vortexes 50 as fluid is forced through apertures 16. Apertures 16 may be designed or configured with any amount, shape, size, configuration or the like for creating the desired turbulence for the desired enhancement of thermal transport in hydronic small-scale heat transfer system 11. In select embodiments of pulse pump 10, plurality of apertures 16 may include plurality of rows 26 of apertures 16. The plurality of rows 26 may be any desired number of rows 26. Each of the plurality of apertures 16 may have shape 28. Shape 28 may be, but is not limited to, circular hole shape 30 (see FIGS. 7 and 10), star shape (not shown in Figures), plus sign shape (not shown in Figures), slit shape (not shown in Figures), slot shape 38, spread nozzle with a specific angle (not shown in the Figures), like a power washer nozzle, the like, or combinations thereof. In select possibly preferred embodiments, as shown in FIGS. 2, 5 and 9, shape 28 of each of the plurality of apertures 16 may be slot shaped apertures 44. Slot shaped apertures 44 of each of the plurality of apertures 16 may be angled slots 46. Angled slots 46 may be angled from inlet 12 side of pulsing chamber 14 down to flow channel 20 towards outlet 22 in flow channel 20. The plurality of angled slot 46 shaped apertures 16 may include plurality of rows 26 of angled slot 46 shaped apertures 16, as shown in FIGS. 2, 5 and 9. However, the disclosure is not so limited and any size, shape, amount, configuration, the like etc., of apertures 16 or angled slots 46 may be included.

Figure 3:
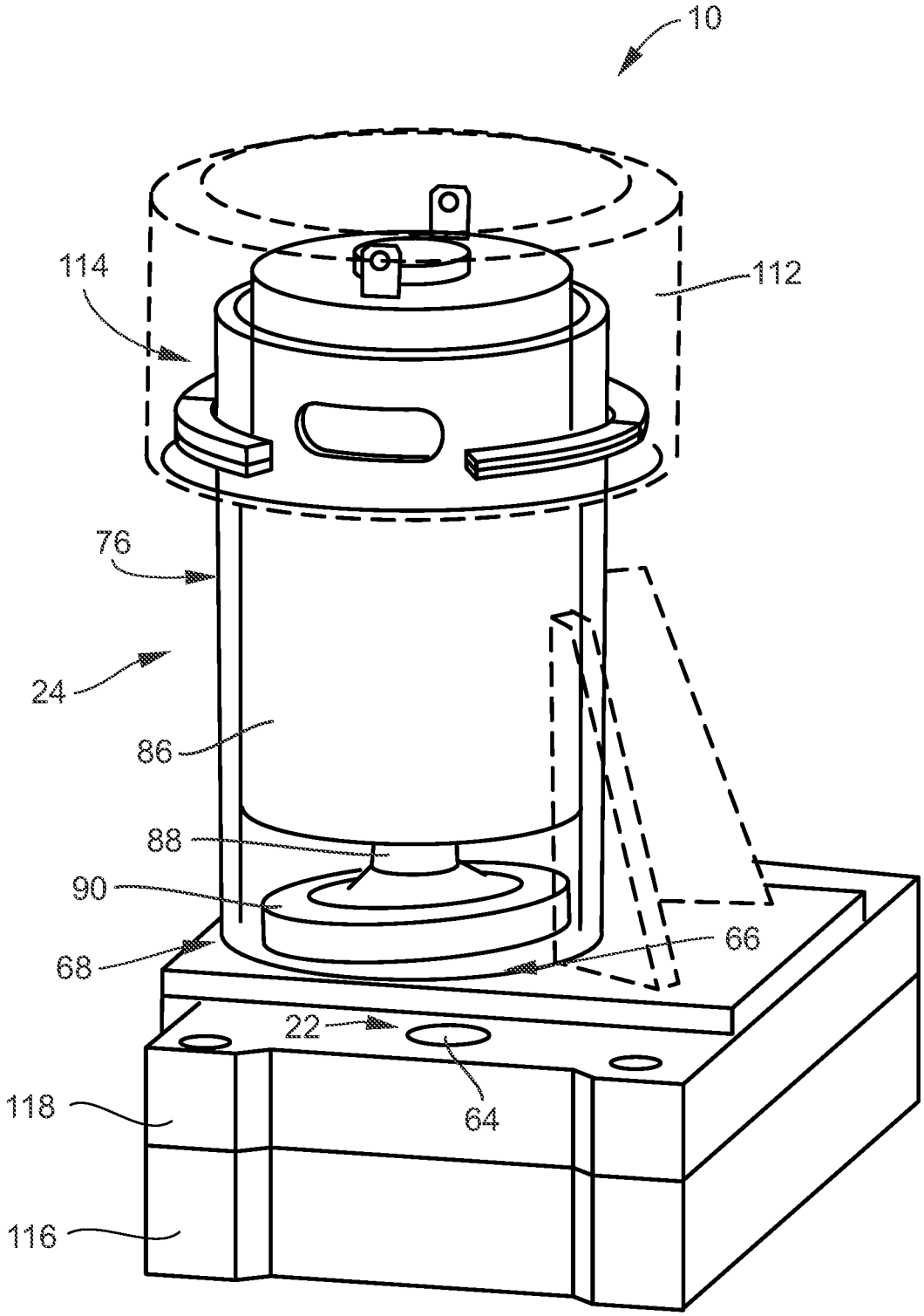
FIG. 3 shows a perspective view of a pulse pump for the enhancement of thermal transport in hydronic small-scale heat transfer systems according to select embodiments of the instant disclosure with a vertical motor and wavy disc configuration for operating the pulse pump.
Figure 4:
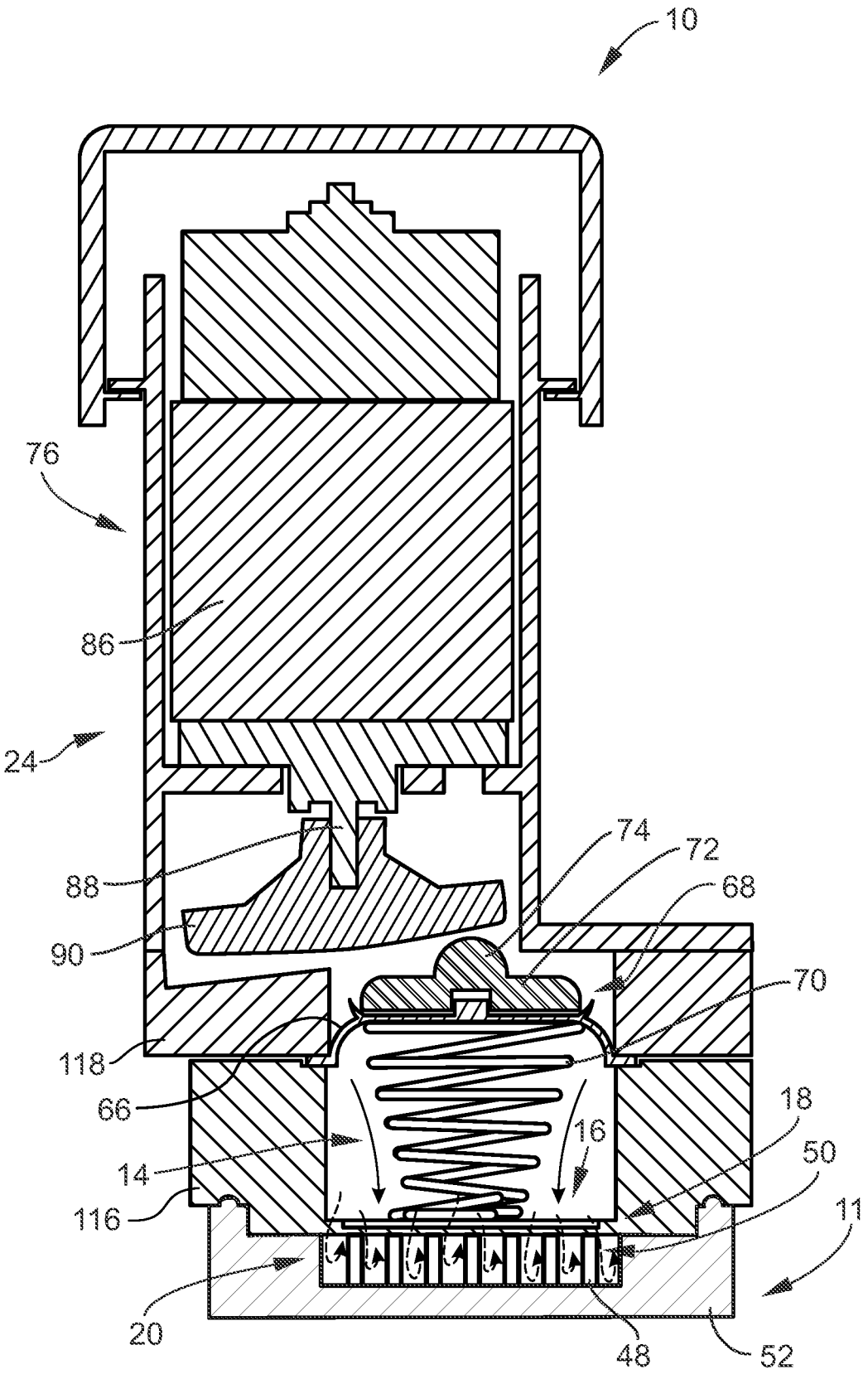
FIG. 4 shows a cross-sectional view of the pulse pump for the enhancement of thermal transport in hydronic small-scale heat transfer systems from FIG. 3 showing the vertical motor and wafer configuration for operating the pulse pump.

In select embodiments of pulse pump 10 for the enhancement of thermal transport in hydronic small-scale heat transfer system 11, hydronic small-scale heat transfer system 11 may include micro-channels 48, as shown in FIGS. 2, 4 and 5. Micro-channels 48 may be positioned in flow channel 20. Wherein, pulsing pump 24 may be configured to force fluid through apertures 16 to be injected into micro-channels 48 with turbulent vortexes 50 for the enhancement of thermal transport into micro-channels 48. Referring now specifically to FIGS. 2, 4 and 5, in select embodiments, micro-channels 48 may be positioned on copper block 52. Copper block 52 may be sealed to bottom 18 of pulsing chamber 14. Copper block 52 may include inlet chamber 54 on one side 56 of micro-channels 48 and outlet chamber 58 on another side 60 of micro-channels 48. This configuration of copper block 52 may provide for flow paths from one side 56 of micro-channels 48 through micro-channels 48 and to another side 60 of micro-channels 48. As shown in FIG. 5, copper block 52 may be positioned under bottom block 116 configured to house pulsing chamber 14 with apertures 16 at bottom 18 thereof. With this configuration, copper block 52 would be sealed to the bottom of this bottom block 116 housing pulsing chamber 14 with apertures 16 at bottom 18 thereof (as shown in FIGS. 2 and 4), and this bottom block 116 shown in FIG. 5 housing pulsing chamber 14 with apertures 16 at bottom 18 thereof would be the bottom portions shown in FIGS. 1 and 2 of pulsing pump 10. As shown in FIGS. 1-4, this bottom block 116 is sealed to a top block 118 with flexible diaphragm 66 sealed therebetween for creating pulsing chamber 14. Bottom block 116 may be sealed to top block 118 by any means, including any mechanical fasteners or screws for tightening top block 118 onto bottom block 116 for sealing flexible diaphragm 66 therebetween, as best shown in FIGS. 2 and 4.

Referring now to FIGS. 1 and 3, in select embodiments of pulse pump 10 for the enhancement of thermal transport in hydronic small-scale heat transfer system 11, first one-way valve 62 and/or second one-way valve 64 may be included. First one-way valve 62 may be positioned in inlet 12. Where, first one-way valve 62 may be configured for only allowing flow from inlet 12 to pulsing chamber 14. Second one-way valve 64 may be positioned in outlet 22. Where, second one-way valve 64 may be configured for only allowing flow from flow channel 20 out of outlet 22. First one-way valve 62 alone, second one-way valve 64, alone, or the combination of first one-way valve 62 and second one-way valve 64, may be designed to prevent fluid from being forced by pulsing pump 24 in the wrong direction.

Pulsing pump 24 may be included with pulse pump 10 for the enhancement of thermal transport in a hydronic small-scale heat transfer system 11. Pulsing pump 24 may be for providing a means or mechanism for forcing fluid from pulsing chamber 14 through apertures 16 at bottom 18 for creating turbulence in flow channel 20. Pulsing pump 24 may include any members, mechanisms, devices, machines, means, the like, or combinations thereof, configured for forcing or pumping fluid from pulsing chamber 14 through apertures 16 at bottom 18 for creating turbulence in flow channel 20. In select embodiments, as shown in the Figures, but clearly not limited thereto, pulsing pump 24 may include flexible diaphragm 66. Flexible diaphragm 66 may be positioned at top 68 of pulsing chamber 14. Flexible diaphragm 66 may be configured for flexing downward for forcing fluid in pulsing chamber 14 through the plurality of apertures 16 at bottom 18 of pulsing chamber 14. In select embodiments, flexible diaphragm 66 may be biased upwards for moving flexible diaphragm 66 upward after it has been flexed downwards by pulsing pump 24. Wherein, when flexible diaphragm 66 is biased upward, fluid is pulled into pulsing chamber 14 from inlet 12. In select embodiments, spring 70 may be positioned inside of pulsing chamber 14. See FIGS. 2, 4, 6 and 8. Spring 70 may be positioned inside of pulsing chamber 14 and may be configured for biasing flexible diaphragm 66 upward from pulsing chamber 14. However, the disclosure is not so limited to spring 70 biasing flexible diaphragm 66 upward. Any other device may be used for moving flexible diaphragm 66 upward after it has been compressed downward. As an example, and clearly not limited thereto, a crank slider type arrangement (see FIG. 7), piston cylinder type arrangement (see FIG. 9), or piezo electric disc (see FIG. 10) may be used where the driving mechanism 76 positively forces the flexible diaphragm 66 upwards after it has been flexed downwards. Spacer 72 may also be included on top of flexible diaphragm 66. Spacer 72 may be sized and configured for connecting flexible diaphragm with pulsing pump 24, like driving mechanism 76 with any connecting means or devices. Spacer 72 may include insert 74 configured for providing a surface or material configured for being forced down onto flexible diaphragm 66 for compressing flexible diaphragm 66 downwards into pulsing chamber 14.

Driving mechanism 76 may be included with pulsing pump 24 of pulse pump 10 for the enhancement of thermal transport in hydronic small-scale heat transfer system 11. Driving mechanism 76 may be for providing the device, force or means for forcing fluid from pulsing chamber 14 through apertures 16 at bottom 18 of pulsing chamber 14 and into flow channel 20 for creating turbulent vortexes 50 in, on or around hydronic small-scale heat transfer system 11, like in, on or around micro-channels 48. Driving mechanism 76 may include any device, mechanism, members, machines, means, the like, or combinations thereof for providing the device, force or means for forcing fluid from pulsing chamber 14 through apertures 16 at bottom 18 of pulsing chamber 14 and into flow channel 20 for creating turbulent vortexes 50 in, on or around hydronic small-scale heat transfer system 11, like in, on or around micro-channels 48. In select embodiments, as shown in the Figures, driving mechanism 76 may be configured for compressing flexible diaphragm 66 downwards at a set interval. This set interval and the speed and/or force of compression of flexible diaphragm 66 may be varied via driving mechanism 76.

Referring now specifically to the embodiments of pulse pump 10 shown in FIGS. 1 and 2, in select embodiments, driving mechanism 76 may include horizontal motor 80. Horizontal motor 80 may be positioned horizontally or transverse with the downward motion of diaphragm 66. Horizontal motor 80 may be held in position via motor mount 112, which may include lubricating device 114 for keeping horizontal motor 80 lubricated. Horizontal motor 80 may have horizontal drive shaft 82. On the distal end of horizontal drive shaft 82, offset cam 84 may be attached to horizontal drive shaft 82. Offset cam 84 may be positioned on top of flexible diaphragm 66. Wherein, when horizontal drive shaft 82 is rotated by horizontal motor 80, offset cam 84 may be configured to compress diaphragm 66 downwards at the desired set interval.

Referring now specifically to the embodiments of pulse pump 10 shown in FIGS. 3 and 4, in select embodiments, driving mechanism 76 may include vertical motor 86. Vertical motor 86 may be positioned vertically or parallel with the downward motion of diaphragm 66. Vertical motor 86 may be held in position via motor mount 112, which may include lubricating device 114 for keeping vertical motor 86 lubricated. Vertical motor 86 may include vertical drive shaft 88. On the distal end of vertical drive shaft 88, wavy disc 90 may be attached to vertical drive shaft 88. See FIGS. 4 and 6. Wavy disc 90 may be positioned on top of flexible diaphragm 66. Wherein, when vertical drive shaft 88 is rotated by vertical motor 86, wavy disc 90 may be configured to compress diaphragm 66 downwards at the set interval.

Figure 7:
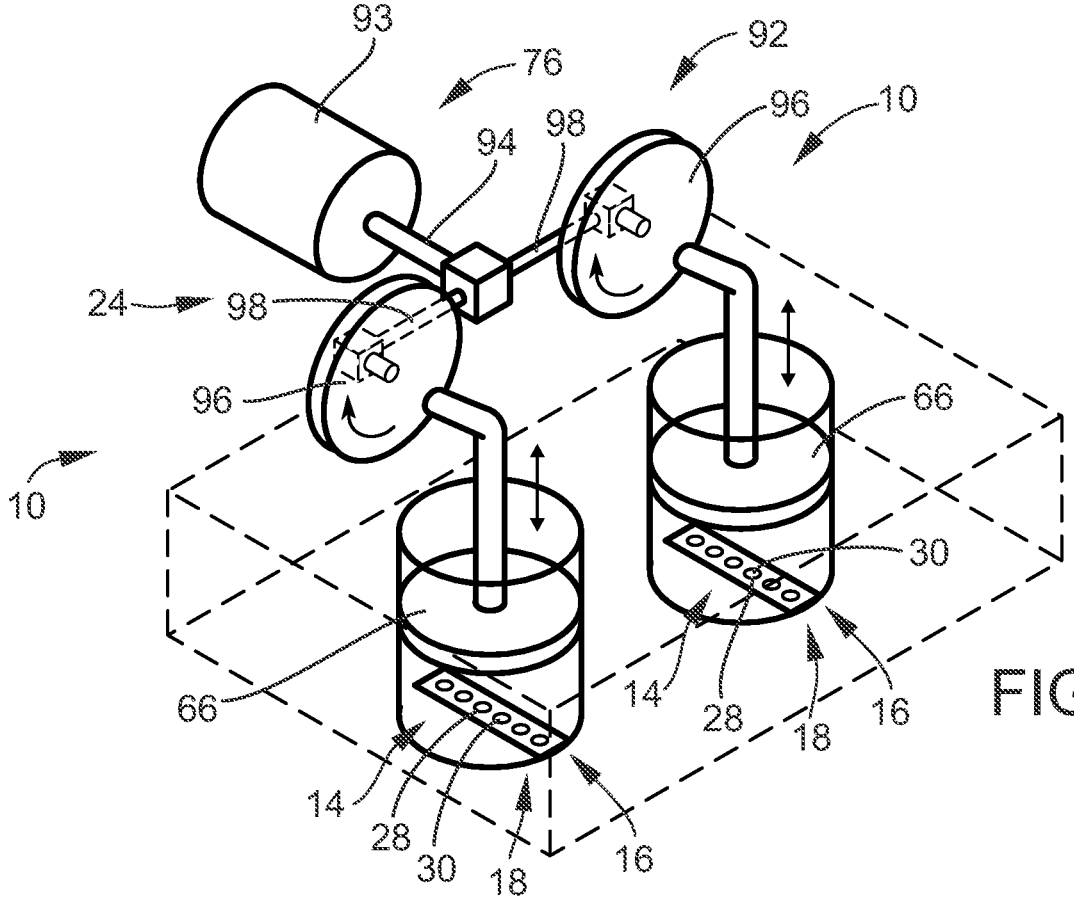
FIG. 7 shows a schematic perspective view of a pulse pump for the enhancement of thermal transport in hydronic small-scale heat transfer systems according to select embodiments of the instant disclosure with a horizontal motor driving 2 cranks with connecting rods configuration for operating 2 pulse pumps.

Referring now specifically to FIGS. 7 and 9, in other select embodiments, driving mechanism 76 may include single motor two pump configuration 92. Single motor two pump configuration 92 may be configured to operate two pulse pumps 10 via single motor 93. In select embodiments of single motor two pump configuration 92, single motor 93 may include single horizontal drive shaft 94 linked to two cranks 96 via connecting rods 98, as shown in FIG. 7. In other select embodiments of single motor two pump configuration 92, single motor 93 may be linked to two piston cylinders 100, as shown in FIG. 9.

Figure 8:
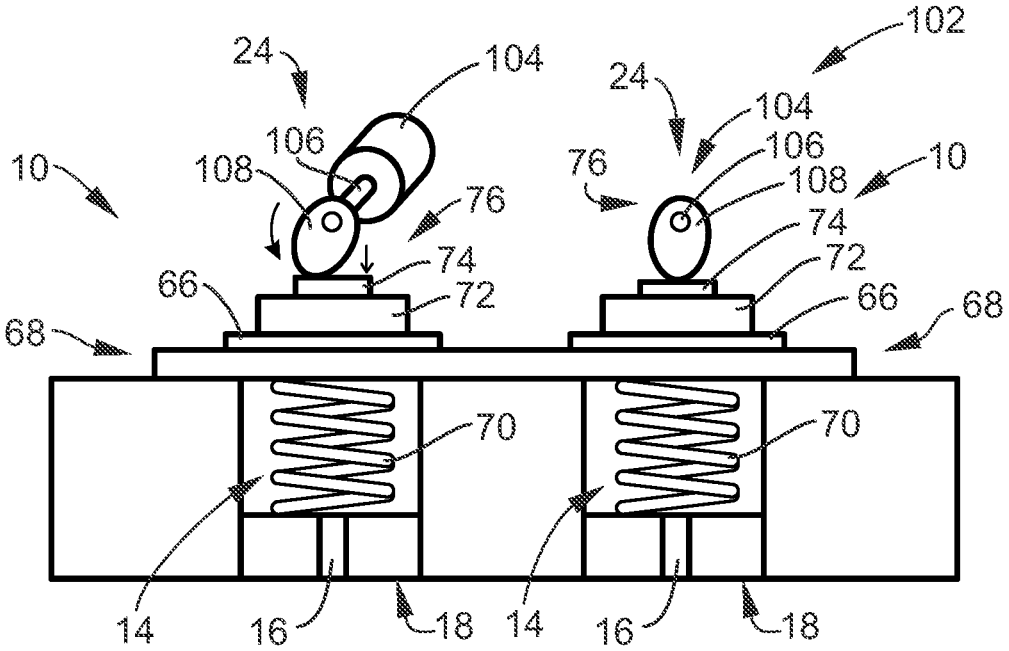
FIG. 8 shows a schematic side view of a pulse pump for the enhancement of thermal transport in hydronic small-scale heat transfer systems according to select embodiments of the instant disclosure with 2 horizontal motors, each with an offset cam, configuration for operating 2 pulse pumps.
Figure 10:
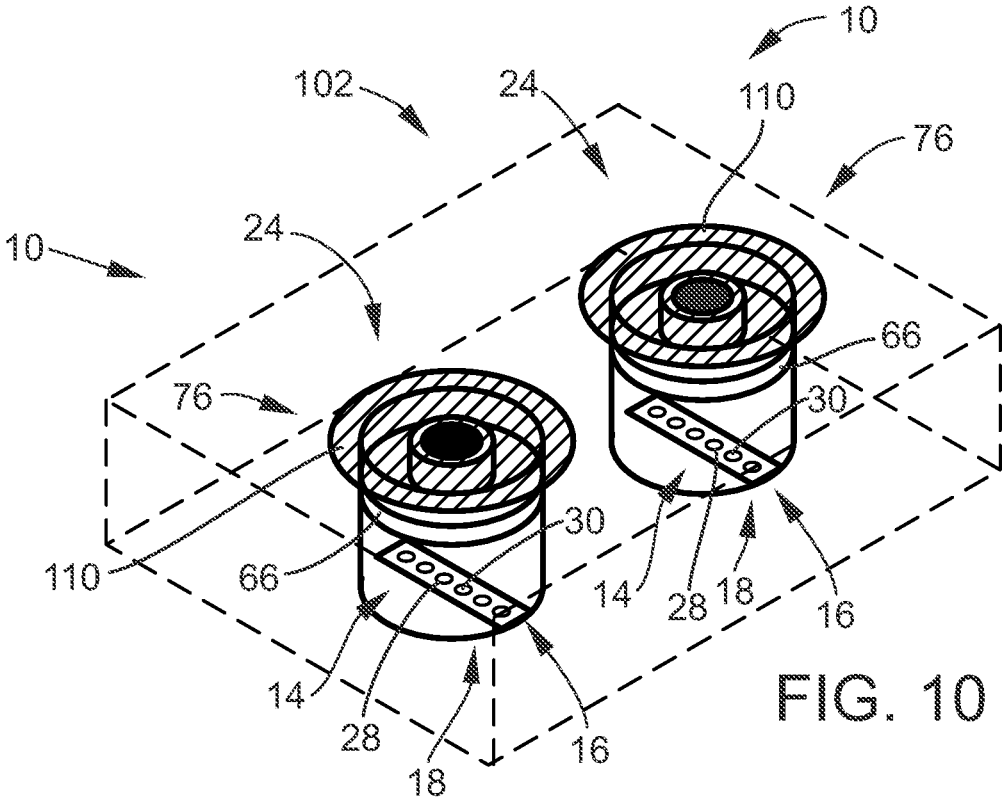
FIG. 10 shows a schematic perspective view of a pulse pump for the enhancement of thermal transport in hydronic small-scale heat transfer systems according to select embodiments of the instant disclosure with piezo electric discs for operating 2 pulse pumps.

Referring now specifically to FIGS. 8 and 10, in other select embodiments, driving mechanism 76 may include two motor two pump configuration 102. Two motor two pump configuration 102 may be configured to operate two pulse pumps 10 via two motors 104. In select embodiments of two motor two pump configuration 102, each of the two motors 104 may include horizontal drive shaft 106 with offset cam 108 thereon, as shown in FIG. 7. In other select embodiments of two motor two pump configuration, 102 each of the two motors 104 may be piezo electric disc 110 configured to operate flexible diaphragm 66 of pulse pump 10.

As best shown in FIGS. 1-4, in select embodiments, each of the motors 80, 86, 93 or 104 may be housed in motor mount 112. Motor mount 112 may be configured for positioning the motor in communication with flexible diaphragm 66. In select embodiments, motor mount 112 may include lubricating device 114 configured for keeping the motor it houses lubricated.

Figure 11:
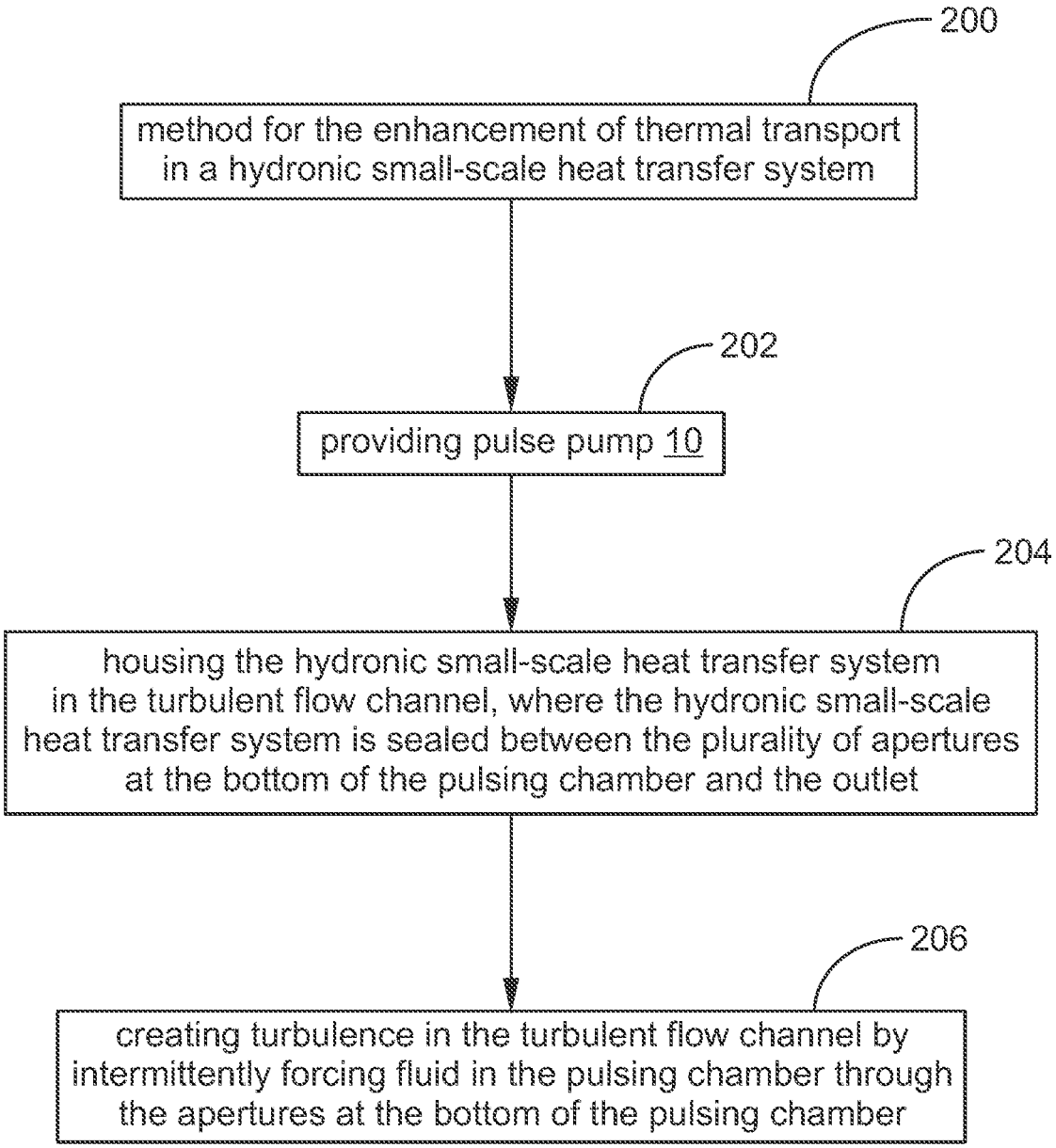
FIG. 11 shows a flow chart for a method for the enhancement of thermal transport in a hydronic small-scale heat transfer system according to select embodiments of the instant disclosure.

Referring now to FIG. 11, in another aspect, the instant disclosure embraces method 200 for the enhancement of thermal transport in hydronic small-scale heat transfer system 11. Method 200 for the enhancement of thermal transport in hydronic small-scale heat transfer system 11 may generally include providing and utilizing the disclosed pulse pump 10 in any embodiment or combination of embodiments shown and or described herein. As such, method 200 for the enhancement of thermal transport in hydronic small-scale heat transfer system 11 may include step 202 of providing pulse pump 10 for the enhancement of thermal transport in hydronic small-scale heat transfer system 11 in any of the various embodiments and/or combination of embodiments shown and/or described herein. With the provided pulse pump 10, method 200 may also include the steps of: step 204 of housing the hydronic small-scale heat transfer system 11 in flow channel 20, where hydronic small-scale heat transfer system 11 may be sealed between the plurality of apertures 16 at bottom 18 of pulsing chamber 14 and outlet 22; and step 206 of creating turbulence (like turbulent vortexes 50) in flow channel 20 by intermittently forcing fluid in pulsing chamber 14 through apertures 16 at bottom 18 of pulsing chamber 14, like via pulsing pump 24. However, method 200 is not so limited and may include any other steps for utilizing pulse pump 10 in any of the various embodiments and/or combination of embodiments shown and/or described herein.

In sum, the present disclosure embraces a device 10 and method 200 for enhancing internal flow parameters, through a turbulence enhancement device for the purpose of increased heat transfer. One method to increase the turbulence in the flow is to use central net zero pulse pump device 10. This pulse pump 10 may have a single net zero pulse pump for the heat exchanger system 11. The pulse pump device 10 may sit directly on top of or mount directly over the heat exchange system 11, like micro-channels 48. The pulse pump 10 will pull in the working fluid through inlet 12, like a hole or series of holes, into pulsing chamber 14. The working fluid will then be forced back out by the device through apertures 16, like a hole or series of holes, into flow channel 20, as a jet of fluid. This will create turbulence, like turbulent vortexes 50, in flow channels 20 and increase thermal transport. The apertures 16 where the net zero pulse pump 10 pull in and inject fluid can be in various configurations and or of any design. For example, in one instance the apertures 16 could just be a circular hole 30. In another instance the apertures could be of other advantageous shapes such as a star shape, a (+) plus sign, a slit (–), a spread nozzle with a specific angle such as is used on a pressure washer.

For any of the shapes that could be used or chosen at the injection point it would be apparent or obvious to someone knowledgeable in the area of fluids or heat transfer that the shape would be advantageous to enhanced thermal transport. Thus, the apertures 16 could be of various configurations. For example, in some heat exchanger system 11 configurations where there are micro-channels 48 the flow will laminar very shortly after entering micro-channels 48. The distance to laminar flow/velocity profile can be calculated. It may be advantageous to put a row 26 or plurality of rows 26 of pulse jets via apertures 16 at that location to induce turbulence into flow channels 20. Because the channels are small the flow could again become laminar and the turbulence from the pulse will dissipate. At the distance this happens another row of pulse jets from apertures 16 via pulse pump 10 could again induce turbulence. Depending on the length of micro-channels 48 this may need to be done multiple times and at appropriate distances from the previous pulse jet. Furthermore, the timing of the pulses will be such that the pulses happen at the correct and most appropriate time in order to maximize heat transfer enhancement.

Since flowrates in thermal management systems are typically variable, net zero pulse pump device 10 could also be variable. This variable feature of pulse pump device 10 could allow the frequency of the pulses to vary in concert with the flowrate in order to give the best possible enhancement of heat transfer at all flowrates. In addition to the frequency of the pulses the amplitude of the pulses would or could be varied. This would mean a larger or smaller volume of fluid could be injected to the flow relative to the flowrate of the system. Therefore, both the frequency of the fluid injections and the volume of the fluid injections could vary with flowrate of the thermal management system 11.

Another method would be to have individual net zero pulse pump devices mounted in advantageous positions on the heat exchanger 11. They could also be actuated or driven by either separate devices/mechanisms or a common device/mechanism. The common device/mechanism means that one device/mechanism would drive multiple pulse pump positions and jets. Each one of the individual pulse devices could have the possibility of different nozzle designs. Where they connect to the heat exchanger the design of the opening to the flow could be of any design. The individual pulse devices will allow the frequency of the pulses to vary in concert with the flowrate in order to give the best possible enhancement of heat transfer. In addition to the frequency of the pulses the amplitude of the pulses would or could be varied. Unlike the single pulse pump device 10, the individual devices could either all act in concert together or act to give individual pulse frequencies and amplitude/volume pulses. This ability could increase heat transfer by allowing variation to the frequency, amplitude/volume of the pulse at respective individual locations in the heat exchanger 11 where necessary for optimal heat transfer enhancement. The control of said parameters can be used to provide increased heat transfer as volumetric flow through the system changes based on heat transfer needs. Since many systems have varying flowrates, an increase in heat transfer can vary with flowrate and system size.

Pulse pump 10 could also be driven or actuated from the circulation pump or the motor that drives it. Meaning the device (like an electric motor) that makes the fluid flow through/around the heat transfer loop would also drive the actuator for the net zero pulse pump 10.

The net zero pulse pump 10 can be of many different configurations. The ones listed are just examples of possible actuation mechanisms and in the scope of this disclosure are not meant to be exhaustive or limiting to the disclosure. To anyone skilled in engineering many different actuating possibilities exist. The examples of actuation devices for the net zero pulse pump 10 may be, but are not limited to: are: electric motor with crank which will actuate the pump; electric motor with offset cam which will actuate the pump; solenoid which would directly actuate the pump; solenoid which would indirectly actuate the pump by means of levers, offset cams or other kinematic arrangements; piezoelectric device in which a disc is flexed to directly act as the pump; magnetostrictive materials in which the magnetostrictive material would directly or indirectly be the actuation device for the pump; pneumatic and or hydraulic devices in which the respective device would directly or indirectly be the actuation device for the pump; and/or any combination of previously mentioned devices acting on a piston, diaphragm or flexing material to act as the pump.

The net zero pulse pump device 10 can be of many different configurations. The ones listed are just examples of possible pump devices and in the scope of this disclosure are not meant to be exhaustive or limiting to the disclosure. To anyone skilled in engineering many different actuating possibilities exist. Examples of pump devices for the net zero pulse pump 10 may be, but are not limited to, diaphragm; piston; flexing material; the like, or combinations thereof.

The fluid pulses or jets are deductive for an increase in the convective coefficient. This increase in the convective coefficient through the increase of turbulence in the fluid will increase the heat transfer of the hydronic system 11 which may decrease energy usage and operating costs.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A pulse pump for enhancement of thermal transport in a hydronic small-scale heat transfer system comprising:

an inlet;

a pulsing chamber in fluid communication with said inlet;

a plurality of apertures at a bottom of the pulsing chamber;

a flow channel sealed to the bottom of the pulsing chamber below the plurality of apertures, the flow channel being configured to house the hydronic small-scale heat transfer system;

an outlet in fluid communication with the flow channel; and a pulsing pump in communication with the pulsing chamber configured for intermittently forcing fluid in the pulsing chamber through the apertures at the bottom of the pulsing chamber thereby creating turbulence in the flow channel.

2. The pulse pump of claim 1, wherein the turbulence created in the flow channel enhancing thermal transport in the hydronic small-scale heat transfer system.

3. The pulse pump of claim 1 being a net zero pulse pump, wherein the flow between the inlet and the outlet is in a closed loop of the hydronic small-scale heat transfer system where no fluid is added or taken out of the closed loop.

4. The pulse pump of claim 1, wherein the plurality of apertures including a plurality of rows of the apertures.

5. The pulse pump of claim 1, wherein each of the plurality of apertures having a shape being selected from a group consisting of: a circular hole shape, a star shape, a plus sign shape, a slit shape, a slot shape, and a spread nozzle with a specific angle.

6. The pulse pump of claim 5, wherein the shape of each of the plurality of apertures being slot shaped apertures, wherein the slot shaped apertures of each of the plurality of apertures being angled slots, where the angled slots are angled from the inlet side of the pulsing chamber down to the flow channel towards the outlet in the flow channel.

7. The pulse pump of claim 6, wherein the plurality of angled slot shaped apertures including a plurality of rows of the angled slot shaped apertures.

8. The pulse pump of claim 1, wherein the hydronic small-scale heat transfer system including micro-channels positioned in the flow channel, wherein the pulsing pump is configured to force fluid from the apertures to be injected into the micro-channels with turbulent vortexes for the enhancement of thermal transport in the micro-channels.

9. The pulse pump of claim 8, wherein the micro-channels are positioned on a copper block sealed to the bottom of the pulsing chamber, the copper block including an inlet chamber on one side of the micro-channels and an outlet chamber on another side of the micro-channels.

10. The pulse pump of claim 1 further comprising:

a first one-way valve positioned in the inlet configured for only allowing flow from the inlet to the pulsing chamber;

a second one-way valve positioned in the outlet configured for only allowing flow from the flow channel out of the outlet;

or combinations thereof.

11. The pulse pump of claim 1, wherein the pulsing pump including a flexible diaphragm positioned at a top of the pulsing chamber, the flexible diaphragm is configured for flexing downward for forcing fluid in the pulsing chamber through the plurality of apertures at the bottom of the pulsing chamber.

12. The pulse pump of claim 11, wherein the flexible diaphragm is biased upwards for moving the flexible diaphragm upward after it has been flexed downwards by the pulsing pump, wherein when the flexible diaphragm is biased upward fluid is pulled into the pulsing chamber from the inlet.

13. The pulse pump of claim 12, wherein a spring is positioned inside of the pulsing chamber configured for biasing the flexible diaphragm upward from the pulsing chamber.

14. The pulse pump of claim 11, wherein a spacer is included on top of the flexible diaphragm, the spacer including an insert configured for being forced down onto the flexible diaphragm for compressing the flexible diaphragm downwards into the pulsing chamber.

15. The pulse pump of claim 11, wherein the pulsing pump comprising a driving mechanism configured for compressing the flexible diaphragm downwards at a set interval.

16. The pulse pump of claim 15, wherein the driving mechanism including:

a horizontal motor with a horizontal drive shaft including an offset cam attached to said horizontal drive shaft;

the offset cam is positioned on top of the flexible diaphragm;

wherein, when the horizontal drive shaft is rotated by the horizontal motor, the offset cam is configured to compress the diaphragm downwards at the set interval.

17. The pulse pump of claim 15, wherein the driving mechanism including:

a vertical motor with a vertical drive shaft including a wavy disc attached to said vertical drive shaft;

the wavy disc is positioned on top of the flexible diaphragm;

wherein, when the vertical drive shaft is rotated by the vertical motor, the wavy disc is configured to compress the diaphragm downwards at the set interval.

18. The pulse pump of claim 15, wherein the driving mechanism including:

a single motor two pump configuration configured to operate two of the pulse pumps via a single motor, wherein:

the single motor including a single horizontal drive shaft linked to two cranks via connecting rods; or the single motor being linked to two piston cylinders;

or a two motor two pump configuration configured to operate two of the pulse pumps via two motors, wherein:

each of the two motors including a horizontal drive shaft with an offset cam thereon; or each of the two motors is a piezo electric disc;

wherein, each of the motors being housed in a motor mount configured for positioning the motor in communication with the flexible diaphragm, the motor mount including a lubricating device configured for keeping the motor it houses lubricated.

19. A pulse pump for the enhancement of thermal transport in a hydronic small-scale heat transfer system comprising:

an inlet;

a pulsing chamber in fluid communication with said inlet;

a plurality of apertures at a bottom of the pulsing chamber, wherein the shape of each of the plurality of apertures being angled slot shaped apertures, where the angled slot shaped apertures are angled from the inlet side of the pulsing chamber down to the flow channel towards an outlet in a flow channel, wherein the plurality of angled slot shaped apertures including a plurality of rows of the angled slot shaped apertures;

the flow channel is sealed to the bottom of the pulsing chamber below the plurality of apertures, the flow channel is configured to house the hydronic small-scale heat transfer system, the hydronic small-scale heat transfer system including micro-channels positioned in the flow channel, the micro-channels are positioned on a copper block sealed to the bottom of the pulsing chamber, the copper block including an inlet chamber on one side of the micro-channels and an outlet chamber on the other side of the micro-channels;

the outlet is in fluid communication with the flow channel;

a pulsing pump in communication with the pulsing chamber configured for intermittently forcing fluid in the pulsing chamber through the apertures at the bottom of the pulsing chamber thereby creating turbulence in the flow channel;

the pulsing pump including:

a flexible diaphragm positioned at a top of the pulsing chamber, the flexible diaphragm is configured for flexing downward for forcing fluid in the pulsing chamber through the plurality of apertures at the bottom of the pulsing chamber;

the flexible diaphragm is biased upwards by a spring in the pulsing chamber configured for moving the flexible diaphragm upward after it has been flexed downwards by the pulsing pump, wherein when the flexible diaphragm is biased upward fluid is pulled into the pulsing chamber from the inlet;

a spacer is included on top of the flexible diaphragm, the spacer including an insert configured for being forced down onto the flexible diaphragm for compressing the flexible diaphragm downwards into the pulsing chamber;

a driving mechanism configured for compressing the flexible diaphragm downwards at a set interval;

a first one-way valve positioned in the inlet configured for only allowing flow from the inlet to the pulsing chamber; and a second one-way valve positioned in the outlet configured for only allowing flow from the flow channel out of the outlet;

wherein the pulsing pump is configured to force fluid from the apertures to be injected into the micro-channels with turbulent vortexes for the enhancement of thermal transport into the micro-channels.

20. A method for the enhancement of thermal transport in a hydronic small-scale heat transfer system comprising:

providing a pulse pump comprising:

an inlet;

a pulsing chamber in fluid communication with said inlet;

a plurality of apertures at a bottom of the pulsing chamber;

a flow channel sealed to the bottom of the pulsing chamber below the plurality of apertures;

an outlet in fluid communication with the flow channel; and a pulsing pump in communication with the pulsing chamber;

housing the hydronic small-scale heat transfer system in the flow channel, where the hydronic small-scale heat transfer system is sealed between the plurality of apertures at the bottom of the pulsing chamber and the outlet; and creating turbulence in the flow channel by intermittently forcing fluid in the pulsing chamber through the apertures at the bottom of the pulsing chamber.

* * * * *